US008221061B2

(12) United States Patent
Massot et al.

(10) Patent No.: US 8,221,061 B2
(45) Date of Patent: Jul. 17, 2012

(54) GAS TURBINE ENGINE WITH VALVE FOR ESTABLISHING COMMUNICATION BETWEEN TWO ENCLOSURES

(75) Inventors: Aurelien Rene-Pierre Massot, Vaux le Penil (FR); Philippe Jean-Pierre Pabion, Vaux le Penil (FR); Sebastien Jean Laurent Prestel, Arpajon (FR); Jean-Luc Soupizon, Vaux le Penil (FR)

(73) Assignee: SNECMA, Paris (FR)

( * ) Notice: Subject to any disclaimer, the term of this patent is extended or adjusted under 35 U.S.C. 154(b) by 779 days.

(21) Appl. No.: 12/351,246

(22) Filed: Jan. 9, 2009

(65) Prior Publication Data

US 2009/0180867 A1 Jul. 16, 2009

(30) Foreign Application Priority Data

Jan. 11, 2008 (FR) ..... 08 00170

(51) Int. Cl.
*F01D 5/20* (2006.01)

(52) U.S. Cl. ..... 415/173.2; 415/145; 60/262

(58) Field of Classification Search ..... 415/173.2, 415/185, 182.1, 145, 36, 39; 60/773, 39.49, 60/39, 15, 792, 49, 262
See application file for complete search history.

(56) References Cited

U.S. PATENT DOCUMENTS

| | | | | |
|---|---|---|---|---|
| 5,809,772 | A * | 9/1998 | Giffin et al. | 60/226.1 |
| 2005/0042080 | A1 | 2/2005 | Gendraud et al. | |
| 2006/0048513 | A1 * | 3/2006 | Fukuda et al. | 60/645 |
| 2009/0016874 | A1 * | 1/2009 | Corsmeier et al. | 415/145 |

FOREIGN PATENT DOCUMENTS

GB 1082634 9/1967

* cited by examiner

*Primary Examiner* — Caridad Everhart
(74) *Attorney, Agent, or Firm* — Oblon, Spivak, McClelland, Maier & Neustadt, L.L.P.

(57) ABSTRACT

The present invention relates to a two-spool gas turbine engine including an HP turbine stator ring and an exterior wall of the transition channel between the HP and LP stages, a first enclosure for controlling the stator ring, and a second enclosure for distributing air for blowing the exterior wall of the transition channel. The engine is characterized in that the two enclosures are placed in communication via an orifice controlled by a valve adapted to be open when the pressure P1 in the first enclosure is greater than the pressure P2 in the second enclosure, and closed when P1<P2.

9 Claims, 4 Drawing Sheets

GAS TURBINE ENGINE WITH VALVE FOR ESTABLISHING COMMUNICATION BETWEEN TWO ENCLOSURES

BACKGROUND OF THE INVENTION

1. Field of the Invention

The present invention concerns the field of gas turbine engines and is directed to means for controlling the circulation of air between two enclosures inside the engine, the relative pressure between the two enclosures varying as a function of the operating conditions.

2. Description of the Related Art

A gas turbine engine comprises at least three parts: an air compressor, a combustion chamber and a turbine, the compressor feeding the combustion chamber, which produces hot gases driving the turbine. The turbine is connected to the compressor by a shaft through which it drives the latter. The engine can comprise a number of spools each with a rotor formed of a compressor, a turbine and a shaft mechanically connecting them. In the aeronautical field engines generally have two or three spools. They therefore comprise at least one rotary spool using a low-pressure (LP) drive fluid and one rotary spool using a high-pressure (HP) drive fluid, the two spools being mechanically independent of each other and turning at different speeds.

The search for ever higher efficiency leads to the development for the same engine of low-pressure turbines the average radius of which increases in particular relative to that of the high-pressure turbine, with the aim of reducing the aerodynamic load. There follows the necessity of providing a transition conduit of appropriate geometry between the stages of the high-pressure turbine and the inlet of the low-pressure turbine. This transition conduit remains relatively short because of the aeronautical application of the engine. Such conduits impose on the gases that travel through them a large deflection over a short distance, and therefore have high slopes and high diffusion. To conserve satisfactory flow quality in the swan-neck formed by the transition channel, means for blowing air along the exterior wall of the stream are provided, to avoid thickening and even separation of the boundary layer. The present applicant has developed a solution related to this problem. It is described in patent application FR 0654139 in the name of the present applicant. An enclosure for distribution of blowing fluid is provided between the exterior wall of the transition channel and an element of the turbine casing. The enclosure communicates via a fluid feed orifice with an intake area upstream of the transition channel. This intake area is preferably in the compressor so that the air injected forms a film for thermal protection of the wall.

Moreover, upstream of this transition channel, the annular stream of driving gas is delimited externally by a stator ring. The clearance between the tips of the blades of the HP turbine and the internal face of this ring is kept as small as possible, in all operating phases of the engine, because the efficiency of the turbine depends on it. The HP rotor and stator combination being subjected in operation to different relative radial and axial displacements, there follows a variation of the clearance, which has to be controlled. Air taken from the upstream end of the engine, in the compressor, is used for this purpose to ventilate the stator ring support and to control its expansion as a function of the operating conditions. The air circulating in the ventilation enclosure is then evacuated in the stream. This is known in itself. Note that the control function entails non-continuous circulation of ventilation air. This flow of air is reduced and interrupted, in particular when the operating conditions have stabilized.

If the engine comprises both such means for controlling expansion of the turbine stator ring with a flow of ventilation air circulating in a ventilation enclosure and, immediately downstream thereof, a blowing air distribution enclosure formed around the wall of the transition channel, it would be desirable to use that ventilation air as at least part of the blowing air for the exterior wall of the stream in the transition channel. However, in operation, the differential pressure between said ventilation enclosure and the blowing air distribution enclosure may change. Thus if the circulation of ventilation air is interrupted or reduced, the pressure in the ventilation enclosure falls below that of the distribution enclosure. If there were communication between the two enclosures, an unwanted reflow of gas from the distribution enclosure would occur, interfering with control of the clearance between the stator ring and the tips of the turbine blades.

BRIEF SUMMARY OF THE INVENTION

The present applicant has set itself the following objectives:

Recovering the HP turbine stator ring support ventilation air;

Ensuring that the ventilation air contributes to blowing the exterior wall of the transition channel whilst preventing reflow of air from the blowing air distribution enclosure.

According to the invention, the above objectives are achieved with a two-spool gas turbine engine including an HP turbine stator ring and an exterior wall of the transition channel between the HP and LP stages, a first enclosure for controlling the stator ring, and a second enclosure for distributing air for blowing the exterior wall of the transition channel, characterized in that the two enclosures are placed in communication via an orifice controlled by a valve adapted to be open when the pressure P1 in the first enclosure is greater than the pressure P2 in the second enclosure, and closed when P1<P2.

The invention is advantageous with an engine the two enclosures whereof are separated by a partition pierced by said orifice.

In a preferred embodiment, the valve includes a tubular element engaged in the orifice, with a flared part, a closure slider mobile in the tubular element between a closure position bearing against the flared part and an open position away from the flared part.

Because of the different areas on which the pressures P1 and P2 act, this solution has the additional advantage of ensuring opening of the valve and consequently stable operation of the device when there is a significant pressure difference between the two enclosures.

The tubular element can be fixed in the orifice or alternatively be formed in one piece with the partition.

According to another feature, the valve includes a perforated cover attached to the tubular element against which the slider bears in the open position.

According to a further feature, the valve includes a closure slider with a leakage orifice ensuring a reduced flowrate between the distribution enclosure and the ventilation enclosure in the closed position.

This solution is advantageous because it prevents too high a pressure difference between the enclosures.

According to a further feature, the valve includes a tubular element including a part with a small diameter, a part of greater diameter, the two parts being connected by the flared part, the slider including a guide surface portion cooperating with the larger diameter part to guide the slider inside the tubular element.

This ensures flexible operation of the slider and reduces the risk of jamming in one position or the other.

Alternatively, the valve includes a tubular element including a part with a small diameter, a part of greater diameter, the two parts being connected by the flared part, the slider including a guide surface portion cooperating with the small-diameter part to guide the slider inside the tubular element.

Other features and advantages will emerge from the following description of nonlimiting embodiments of the invention with reference to the appended drawings:

DETAILED DESCRIPTION OF THE INVENTION

Figure 1:
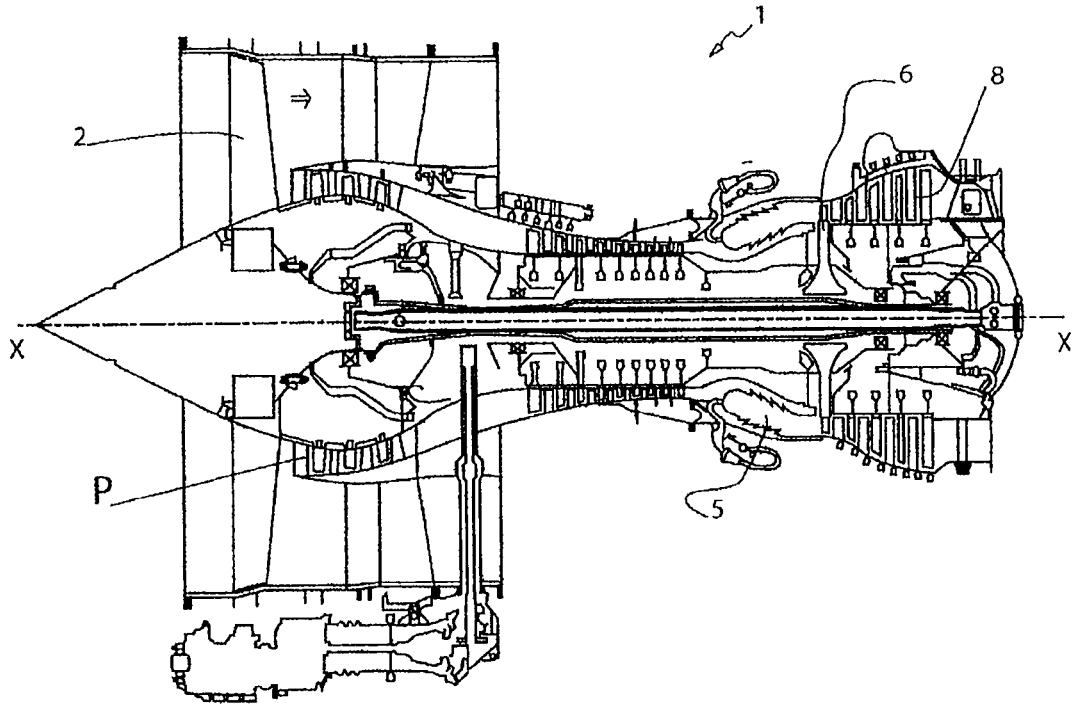
FIG. 1 shows an engine diagrammatically in axial section.

FIG. 1 represents diagrammatically an example of a turbomachine in the form of a two-spool turbofan (bypass turbojet) engine. A fan 2 at the front feeds air to the engine. Air compressed by the fan is divided into two concentric flows. The secondary flow is evacuated directly into the atmosphere, with no other input of energy, and provides an essential portion of the drive thrust. The primary flow is guided through a number of compression stages to the combustion chamber 5 where it is mixed with fuel and burnt. The compression is effected in succession by a booster compressor constrained to rotate with the fan rotor and forming part of the LP rotor and then an HP compressor. The hot gases from the combustion chamber feed the various turbine stages, the HP turbine 6 and the LP turbine 8. The LP and HP turbine rotors are attached to the LP and HP compressor rotors, respectively, and thus drive the fan and the compressor rotors. The gases are then evacuated into the atmosphere.

The HP turbine is a single-stage turbine whereas, in the LP turbine, expansion is divided between a number of stages on the same rotor. A transition channel is formed between the HP and LP sections, to be more precise between the rotor of the HP turbine and the inlet distributor of the LP turbine. Because of the expansion of the gases, the volume increases and also the average diameter of the stream. This increase remains compatible with undisturbed flow conditions, however.

To increase the efficiency of the low-pressure turbine, the profile of the aerodynamic channel is optimized. Such optimization includes increasing the low-pressure turbine inlet slope in the transition channel, which enables a rapid increase in the average radius of the low-pressure turbine. Moreover this increase in the low-pressure distributor inlet section generated by increased diffusion in the channel generates an increase in performance of the first stage with better acceleration in the distributor.

However, a steep low-pressure turbine inlet slope creates a risk of separation of the boundary layer along the exterior wall of the main flow coming from the high-pressure turbine. Such separation strongly degrades the performance of the LP turbine.

One solution is to inject a significant flow of gas via the wall at the outlet of the high-pressure turbine. This injection of air is commonly called blowing.

Figure 2:
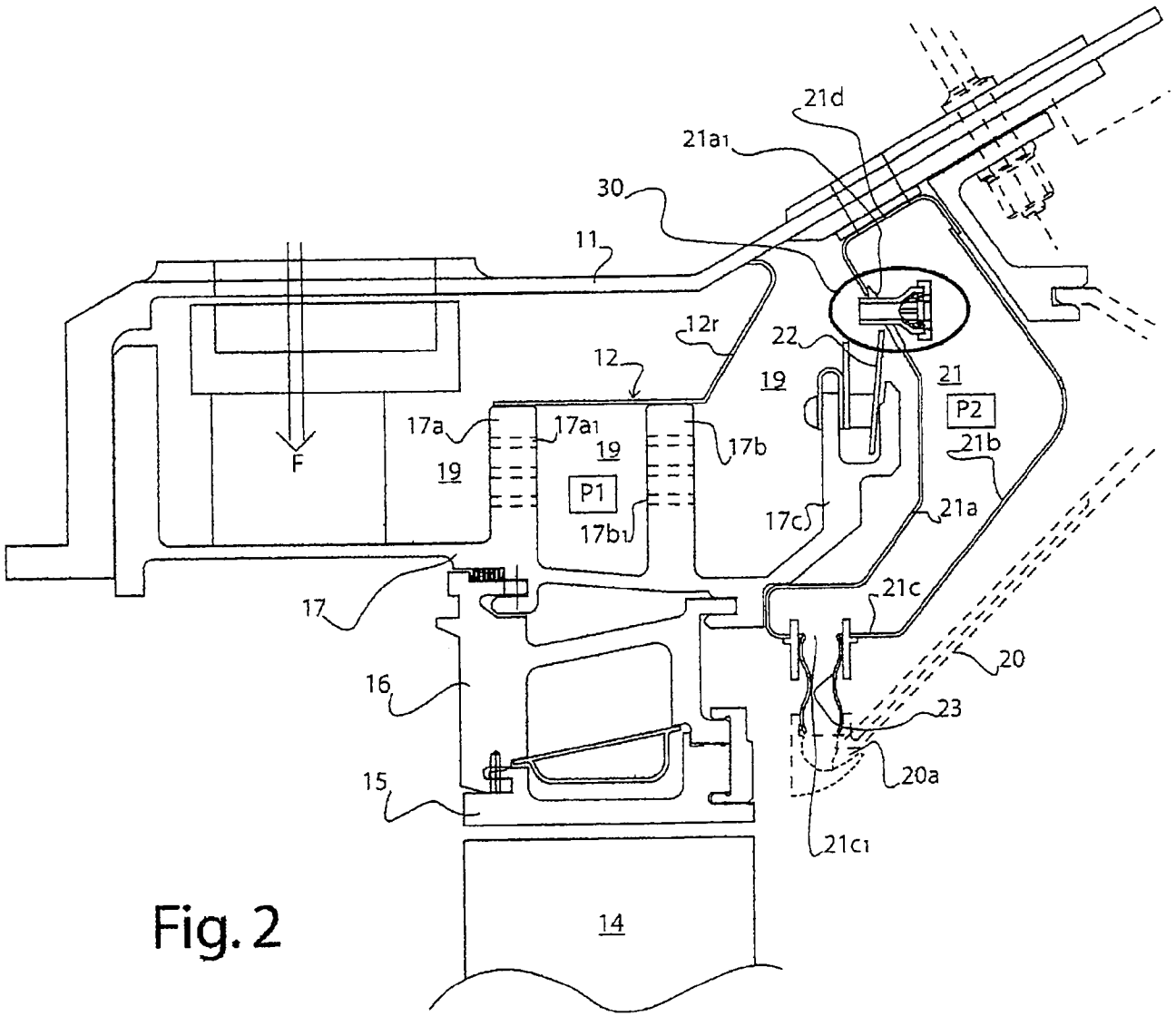
FIG. 2 represents the part of the casing of the engine in the area of the HP turbine and the transition channel provided by the invention.

FIG. 2 represents a portion of the casing of a gas turbine engine in the region of the HP turbine and of the inlet of the transition channel downstream of the latter.

The rotor of the HP turbine, of which the blade 14 can be seen, is rotatable inside an annular space defined externally by a stator ring 15 forming sealing means. Downstream of the turbine, the drive gas stream is delimited externally by the wall 20. This wall is formed of annular sector platforms extending axially between the turbine stator ring 15 and the distributor of the first stage of the LP turbine, which cannot be seen in the figure.

The stator ring 15 is itself formed of sectors mounted in an annular intermediate part 16. The sectors of the ring 15 are retained here by tongue and groove connections on the upstream side and by clamps on the downstream side. The intermediate part 16 is mounted in an internal casing element 17 housed inside the exterior casing 11.

The internal casing 17 includes two radial ribs 17*a* and 17*b* disposed annularly in two transverse planes passing through the rotor of the HP turbine. An annular plate 12 covers the ribs 17*a* and 17*b* and has a radial rim 12*r* that bears against the internal face of the exterior casing 11. A ventilation enclosure 19 is therefore formed between the plate 12 and the internal casing 17. The ribs 17*a* and 17*b* are pierced by axial orifices 17*a*1 and 17*b*1 enabling circulation of gas between the area upstream of the ribs and the area downstream of the ribs. The ventilation is provided by a gaseous flow F coming from an appropriate passage formed upstream of the ventilation enclosure 19.

Downstream of a radial flange 17*c* of the internal casing 17, a blowing air distribution enclosure 21 is formed by a plate that is conformed to include a substantially radial upstream partition 21*a*, a downstream partition 21*b*, also oriented globally radially, a radially interior partition 21*c* and a radially exterior partition 21*d*. A strip seal 22 is placed between the radial flange 17*c* of the internal casing 17 and the partition 21*a*. The enclosure 21 communicates with the enclosure 19 via an orifice 21*a*1 fitted with a valve 30. The enclosure 21 communicates with the gas stream via an opening 21*c*1 formed in the radially internal partition 21*c*, a tube 23, and openings 20*a* along the wall 20 of the transition channel.

Figure 3:
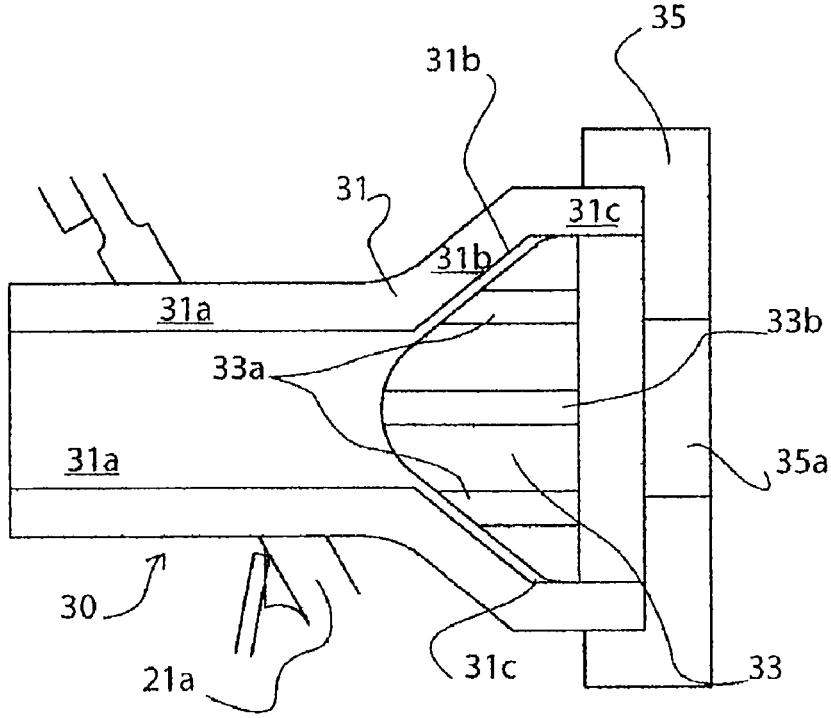
FIG. 3 represents the valve of the invention in axial section.

The valve 30 is represented in more detail in FIG. 3. It comprises a tubular part 31, a slider 33 and a perforated cover 35. The tubular part 31 is formed of a first cylindrical part 31*a* of diameter d1, a second cylindrical part 31*c* of greater diameter d2, d2>d1, and a flared part 31*b*, connecting the two cylinders 31*a* and 31*c*. The slider is housed in the large-diameter part 31*c* with one face conformed to cover the flared part. The slider 33 is pierced with annularly disposed orifices 33*a* and a central orifice 33*b*. The large diameter of the slider corresponds to the inside diameter of the cylindrical part 31*c*. The cover 35 mounted on this part forms an axial abutment for the slider. It is open in its central part at 35*a* facing the orifices 33*a*. The slider can assume an open position, bearing against the cover, in which case the orifices 33*a* are uncovered. The slider 33 can assume a closure or blocking position when it bears against the flared part 31*b*. In this position the orifices 33*a* are closed by the flared wall.

The device operates as follows.

To ensure controlled expansion of the internal casing 17, and thus to ensure control of the clearance at the tips of the blades of the turbine with the stator ring 15, the air F coming from the compressor is conveyed into the enclosure 19 and sweeps over the ribs. It thus enables expansion of the stator ring 15 of the HP turbine. This controls the clearance by controlling the flowrate and the source of air according to the various phases of operation of the engine.

Optimum use is made of this flow of air, after it has swept over the ribs, by sending it into the enclosure 21 located immediately downstream, via the orifice 21*a*1 of the partition 21*a*, to participate in blowing the wall 20 of the transition channel.

Such circulation between the ventilation enclosure 19 and the blowing air distribution enclosure does not give rise to any problem if the pressure P1 in the enclosure 19 is greater than that P2 in the enclosure 21.

If, in certain phases of operation of the engine, it is necessary to cut off or to reduce the feed of ventilation air from the enclosure 19, and if nothing were to be done about it, circulation of air or gas between the enclosure 21 and the enclosure 19 would occur that would compromise controlling the clearance.

The function of the valve is therefore to isolate the enclosure 19 from the enclosure 21 when the pressure P1 is less than P2. The valve 30 is furthermore advantageously configured with a difference between the areas to which the pressures P1 and P2 are applied so that it passes from the closed position, i.e. with the slider bearing against the flared part to achieve closure, to the open position only if the pressure P1 is sufficiently greater than P2 to ensure stable operation.

When the valve is in the closed position, the FIG. 3 solution comprises a central opening 33*b* that enables limited circulation from the enclosure 21 to the enclosure 19 and ensures pressurization of the latter. Alternatively, the valve has no central orifice. In this case it has only one, non-return, function.

Other embodiments of the valves are shown in the subsequent figures.

Figure 4:
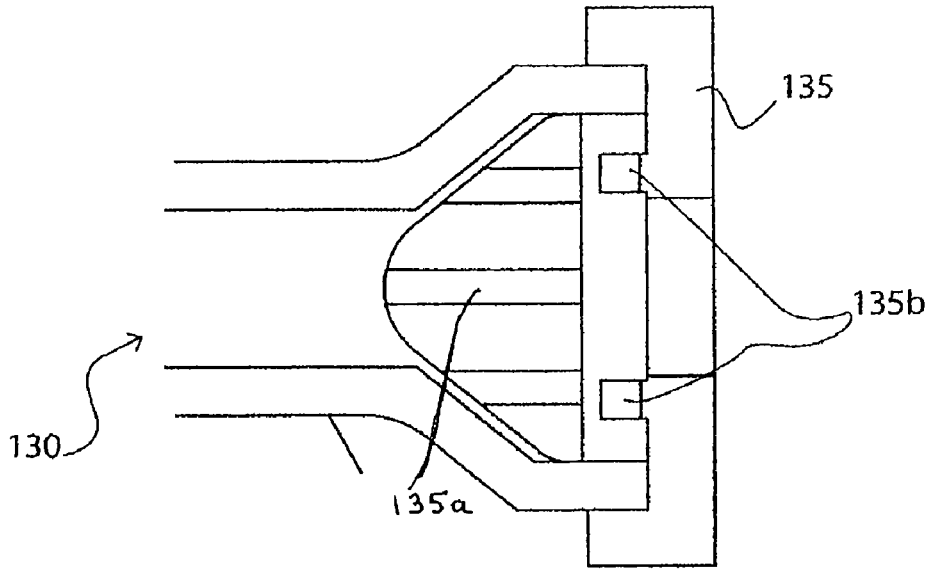

FIG. 4 shows a variant valve 130 with a cover 135 provided with axial projections 135*b* around the central opening 135*a*. These projections limit the bearing area of the slider. The other elements of the valve are not changed compared to that of FIG. 3.

Figure 5:
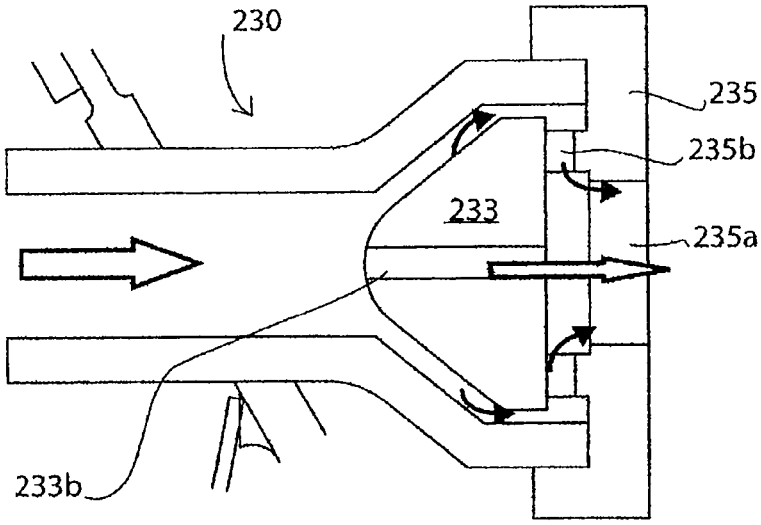
FIGS. 4 to 7 represent in axial section variants of the valve of the invention.

In FIG. 5, the valve 230 differs from the preceding valves in that the slider 233 is of smaller diameter than the large-diameter cylindrical part. It moves freely inside the latter. The cover 235 has projections 235*b* as previously. Air circulates around the slider and through the central bore 233*b* and then circumvents the axial projections 235*b* and passes through the central opening 235*a* of the cover 235.

Figure 6:
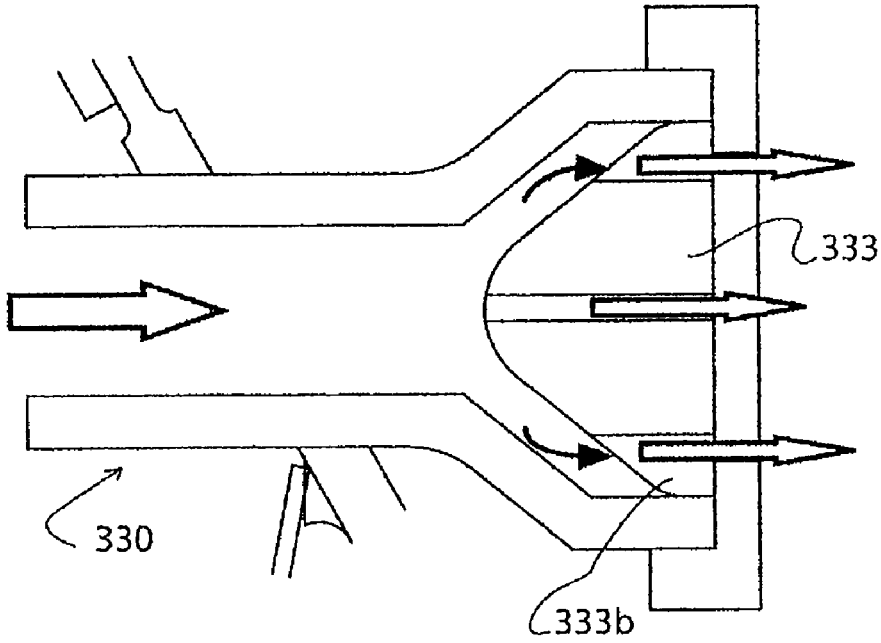

In FIG. 6, the valve 330 includes a slider 333 provided with notches 333*b* at its periphery forming air passages. The valve is otherwise similar to the previous valves.

Figure 7:
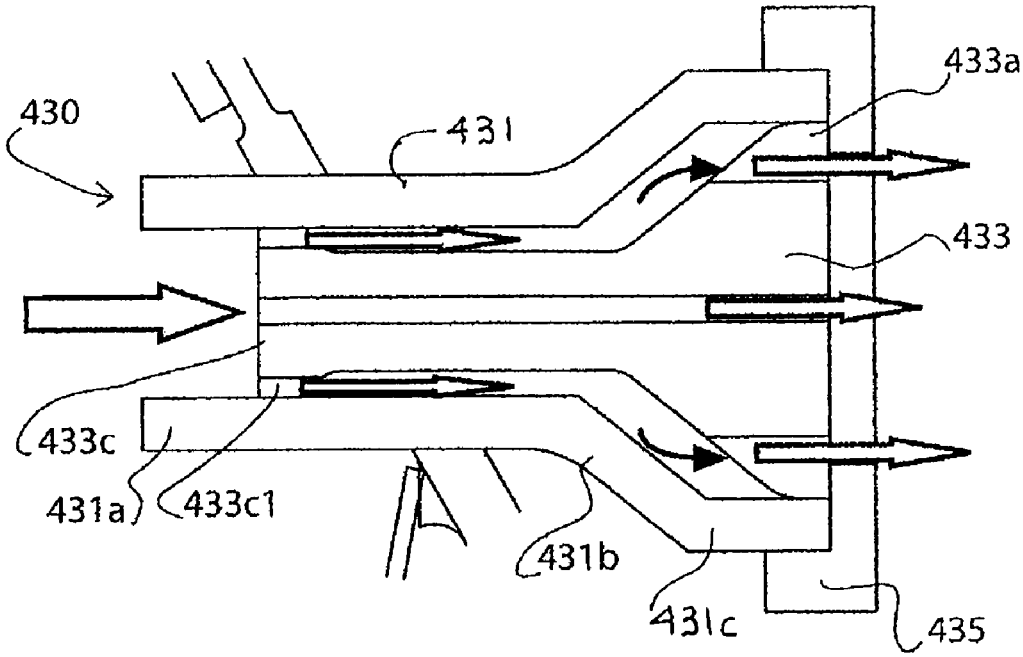

In FIG. 7, the valve 430 includes a slider 433 with a portion 433*c* engaged in the small-diameter part 431*a* of the tubular element 431. This part 433*c* includes air passages 433*c*1. The slider is also guided inside the larger-diameter part 431*c* and comprises openings 433*a* for air to pass through. These openings 433*a* are at the periphery so as to be blocked by the flared part 431*b* when the slider bears against the latter. These openings can be obtained by means of notches as shown in FIG. 7 or by drilling.

The operation of these valve variants is the same as for the valve 30 from FIG. 3, for which they can be substituted. The geometry of these valves enables operation without binding regardless of the operating phase of the engine.

The invention claimed is:

1. A two-spool gas turbine engine, comprising:

an HP turbine stator ring;

an exterior wall of a transition channel disposed between HP and LP turbine stages;

a first enclosure in fluid communication with a gaseous ventilation source for controlling an expansion of the stator ring; and a second enclosure for distributing air for blowing along the exterior wall of the transition channel, wherein the two enclosures are in communication via an orifice controlled by a valve adapted to be open when the pressure P1 in the first enclosure is greater than the pressure P2 in the second enclosure and closed when P1<P2.

2. The engine according to the claim 1, wherein the two enclosures are separated by a partition, the partition pierced by said orifice.

3. The engine according to claim 1, wherein the valve includes a closure slider with a leakage orifice therethrough, the leakage orifice ensuring a reduced flowrate between the two enclosures when the closure slider is in a closed position compared to when the closure slider is in an open position.

4. The engine according to claim 1, wherein the valve includes a closure slider with a plurality of annularly distributed bores forming passages for the gas.

5. The engine according claim 1, wherein:

the valve includes a slider disposed therein, and the slider has a plurality of radial notches forming flow passages for the gas between the slider and the valve.

6. The engine according to claim 1, wherein the valve includes:

a tubular element, with a flared part, the tubular element engaged in the orifice; and a closure slider mobile in the tubular element between a closure position bearing against the flared part and an open position away from the flared part.

7. The engine according to claim 6, wherein the valve includes a perforated cover attached to the tubular element against which the slider bears in the open position.

8. The engine according to claim 6, wherein:

the tubular element includes a small-diameter part, and a large-diameter part connected to the small-diameter part by the flared part, a diameter of the large-diameter part is larger than a diameter of the small-diameter part, and the slider includes a guide surface portion cooperating with the large-diameter part to guide the slider inside the tubular element.

9. The engine according to claim 6, wherein:

the tubular element includes a small-diameter part, and a large-diameter part connected to the small-diameter part by the flared part, a diameter of the large-diameter part is larger than a diameter of the small-diameter part, and the slider includes a guide surface portion cooperating with the small-diameter part to guide the slider inside the tubular element.

* * * * *